United States Patent [19]

Scott et al.

[11] Patent Number: 4,969,193

[45] Date of Patent: Nov. 6, 1990

[54] METHOD AND APPARATUS FOR GENERATING A SIGNAL TRANSFORMATION AND THE USE THEREOF IN SIGNAL PROCESSING

[75] Inventors: Brian L. Scott; R. Gary Goodman; J. Mark Newell; Lloyd A. Smith, all of Denton, Tex.

[73] Assignee: Scott Instruments Corporation, Denton, Tex.

[21] Appl. No.: 372,230

[22] Filed: Jun. 26, 1989

Related U.S. Application Data

[63] Continuation of Ser. No. 770,530, Aug. 29, 1985, abandoned.

[51] Int. Cl.[5] ..... G10L 3/02

[52] U.S. Cl. ..... 381/38; 381/40; 381/41; 381/31

[58] Field of Search ..... 381/29–41, 381/45, 49, 50

[56] References Cited

U.S. PATENT DOCUMENTS

| | | | |
|---|---|---|---|
| 4,230,906 | 10/1980 | Davis | 381/38 |
| 4,267,407 | 5/1981 | Schindler et al. | 381/32 |
| 4,373,191 | 2/1983 | Fette et al. | 381/41 |
| 4,426,551 | 1/1984 | Komatsu et al. | 381/34 |
| 4,435,832 | 3/1984 | Asada et al. | 381/34 |
| 4,441,200 | 4/1984 | Fette et al. | 381/36 |
| 4,672,667 | 6/1987 | Scott et al. | 381/41 |
| 4,700,360 | 10/1987 | Visser | 381/31 |

OTHER PUBLICATIONS

Wolfgang Hess, Pitch Determination of Speech Signals, 1983, pp. 373–383.

Licklider, Bindra, Pollack, The American Journal of Psychology, Jan., 1948, vol. LXI, No. 1, pp. 1–20.

*Primary Examiner*—Gary V. Harkcom
*Assistant Examiner*—David D. Knepper
*Attorney, Agent, or Firm*—Harold E. Meier

[57] ABSTRACT

A method and apparatus for generating a signal transformation useful in signal processing. According to the preferred embodiment, a signal, e.g., a speech waveform, is first converted into a sequence of digital data samples, and a reference position along a first sub-part of the sequence is then selected. A "weighted" histogram corresponding to the reference position is then generated according to a correlation function. Thereafter, a new reference position is selected, for example, at a sub-part of the sequence located a pitch period of the signal from the original reference position, and an additional histogram is generated for this sub-part. The plurality of histograms comprise the transformation of the signal, which retains a substantial part of the informational content of the original signal. Therefore, the transformation is then used as the signal itself in signal processing applications such as speech compression and synthesis.

17 Claims, 2 Drawing Sheets

METHOD AND APPARATUS FOR GENERATING A SIGNAL TRANSFORMATION AND THE USE THEREOF IN SIGNAL PROCESSING

This is a file wrapper continuation, filed June 26, 1989 of case number 06/770,530 filed Aug. 29, 1985, now abandoned.

TECHNICAL FIELD

The present invention relates to signal processing techniques and particularly to a method and apparatus for generating a signal transformation which retains a substantial part of the informational content of the original signal.

BACKGROUND OF THE INVENTION

Audition is a temporally-based sense, whereas vision is primarily spatially-based. In perceiving speech, temporal events as brief as a few thousandths of a second are critical for making simple phonetic or word-based distinctions, such as between "pole" and "bowl," or "tow down" and "towed down." In addition to its highly developed temporal-resolving power, the ear also exhibits excellent spectral resolution and dynamic range. Exactly how the ear exhibits such fine spectral resolution without sacrificing temporal resolution remains a mystery. If more were understood about how the ear works, such knowledge could be applied to speech technologies to improve the performance of speech reocognizers and coding devices.

Satisfactory temporal information from an acoustic speech signal is important for performing certain types of speech processing, e.g., speech segmentation in phonetically-based recognition systems. Likewise, satisfactory spectral resolution of the speech signal is important for other types of speech processing such as speech compression and synthesis. Current state-of-the-art digital signal processors cannot support such diverse speech processing applications because all suffer the classical trade-off of frequency versus time resolution—processors exhibiting good frequency resolution have poor temporal resolution, and vice versa. A digital signal processor having good spectral and temporal resolution would be a tremendous benefit to the speech industry because it would allow a single processing system to approximate the performance characteristics of the ear itself.

An ideal digital signal processor for use in speech processing would provide a unique representation or "transformation" of the speech signal from which all relevant speech features could be derived. As is well known in the art, these features include voice pitch, amplitude envelope, spectrum and degree of voicing. It is presently common in speech systems to use totally different representations of the speech signal to abstract these features, depending on the type of speech processing application being implemented, and the capabilities of the processor carrying out the implementation.

There is therefore a need for a method and apparatus for generating a speech signal transformation which retains a substantial part of the informational content of the original signal, thereby facilitating extraction, from the transformation itself, of the speech features required for varied speech processing applications such as compression and synthesis.

BRIEF SUMMARY OF THE INVENTION

According to the present invention, a method and apparatus is provided for generating a signal transformation which retains a substantial part of the informational content of the original signal required for speech processing applications. As used herein, such applications include speech compression, speech synthesis and speech segmentation. In the preferred embodiment, the transformation is generated by converting all or part of the original signal into a sequence of data samples, selecting a reference position along a first sub-part of the sequence, and generating a histogram for the reference position according to a correlation function. Thereafter, a reference position along a second sub-part of the sequence is selected, and an additional histogram is generated for this reference position. The plurality of histograms generated in this fashion comprise the transformation. According to the invention, the transformation is then used as the signal itself in signal processing applications.

In one embodiment, the transformation comprises a plurality of "weighted" histograms, each having a predetermined number of positions "$d_{max}$" and being derived from a general class of "differencing" functions of the form:

$$\text{histogram}(d,a) = \frac{1}{scnt} \sum_{n=n_0-\left\lfloor \frac{scnt+a\cdot d}{2} \right\rfloor}^{n_0+\left\lfloor \frac{scnt+a\cdot d}{2} \right\rfloor} |x(n) - x(n+d)| \quad \text{for } d = 1,2,\ldots d_{max} \tag{1}$$

where:

x(.) is the sampled signal, $n_0$ is a reference position, d=time lag between samples, scnt=averaging interval in samples, and a=0, 1.

The present invention also includes suitable apparatus for deriving "weighted" histograms according to expression (1) above. In a preferred embodiment, the data samples representing a first sub-part of the sequence are applied sequentially through a differencing correlator having first and second sections, the output of the first section connected to the input of the second section through a temporary storage area. A new data sample is then applied to the first correlator section and the remaining samples therein shifted by one position. A data sample is thereby removed from the first correlator section to the temporary storage area for a first iteration of the differencing calculation. The magnitudes of the data samples in the second correlator section are then differenced with the magnitudes of positionally-corresponding data samples in the first correlator section, and absolute values of these differences are then calculated to produce "even" values which are then added to the histogram for the reference position. Thereafter, the data sample in the temporary storage area (for the first iteration) is applied to the second correlator section and the remaining samples therein shifted by one position. The "differencing," "absolute value" and "summation" steps are then repeated to produce "odd" values of the histogram. This operation (i.e., summation to the "even" and "odd" values) represents one complete cycle of the histogram, and is repeated "scnt" times according to expression (1) to complete the formation of the histogram for the reference position along the first sub-part of the data sample sequence. The process is then repeated for reference positions along other sub-parts of the sequence, each reference position preferably located a pitch period (or multiple thereof) apart, to form additional histograms.

Referring back to equation (1), when a=0, the function "histogram (d,a)" reduces to the well-known average magnitude difference function (AMDF). When a=1, the function "histogram (d,a)" produces a so-called sliding average magnitude difference function (SAMDF), which differs from the AMDF in that the center point of the samples used to compute "histogram (d,l)" is the same for all values of "d." This center point is preferably the reference position, or "$n_0$" in expression (1).

According to an important feature of the present invention, the plurality of "weighted" histograms comprise the transformation of the original signal. It has been found that transformations of the type disclosed herein retain a substantial part of the informational content of the original signal, with only the phase information removed. The transformation is then used according to the invention by various speech or other signal processing applications. For example, to form a compressed version of the original signal, a predetermined portion of each histogram generated every other pitch period of the signal is then stored. Conversely, to implement speech synthesis, the compressed transformation is reconstructed. In neither case, however, does the method require costly and complex conversion of the signal between the time and frequency domains, as in the prior art.

According to the invention a special purpose microprocessor is also provided which, under the control of a software routine, generates the histograms. A general purpose microprocessor is also provided for effecting overall system control, and for controlling specialized processing applications, such as signal compression and synthesis. These microprocessors operate concurrently in a full duplex digital transceiver configuration to facilitate real-time communications to and from the system.

BRIEF DESCRIPTION OF THE DRAWINGS

For a more complete understanding of the present invention and the advantages thereof, reference is now made to the following Description taken in conjunction with the accompanying Drawings in which.

DETAILED DESCRIPTION

Figure 1A:
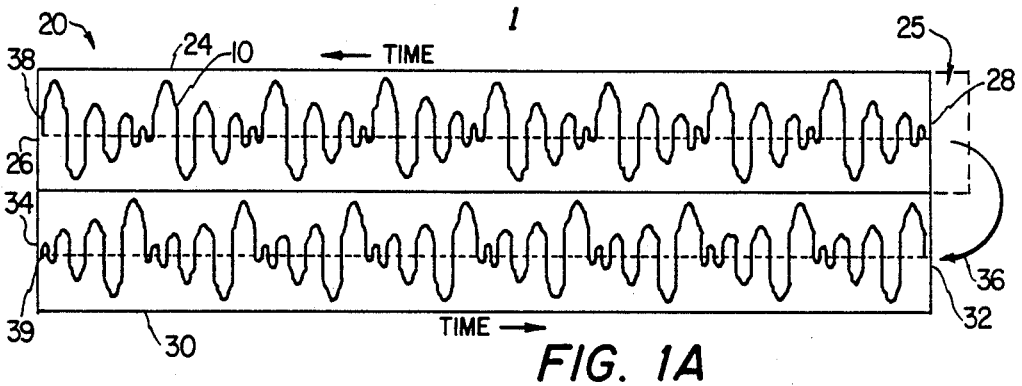
FIG. 1A discloses a correlator structure of the present invention having first and second sections for use in generating histograms according to the present invention.

Referring now to the drawings wherein like reference characters designate like or similar parts throughout the several views, FIG. 1A discloses a correlator structure for generating histograms according to the present invention. As will be described, a plurality of such histograms form a so-called "transformation" of the signal which retains a substantial part of the informational content thereof. For the purpose of explanation only, and not by way of limitation, the technique is explained below with an emphasis on human speech as the source waveform. It should be appreciated, however, that the method and apparatus of the present invention is fully applicable to all types of analog and digital source signals, regardless of how such signals are derived.

In the preferred embodiment, histograms are generated according to one of a plurality of correlation functions. One subset of these functions are so-called "differencing" functions which operate to produce weighted histograms, having $d_{max}$ positions, of the form:

$$\text{histogram}(d,a) = \frac{1}{scnt} \sum_{n=n_0-\left\lfloor \frac{scnt+a\cdot d}{2} \right\rfloor}^{n_0+\left\lceil \frac{scnt+a\cdot d}{2} \right\rceil} |x(n) - x(n+d)| \qquad (1)$$

$$\text{for } d = 1,2,\ldots d_{max}$$

where:

x(.) is the sample signal, $n_0$ is a reference position, d=time lag between samples, scnt=averaging interval in samples, and a=0, 1

According to an important feature of the present invention, it has been found that when a signal is processed to produce "weighted" histograms according to one of a plurality of correlation functions, such as the "differencing" function(s) of expression (1), the resulting transformation (which comprises a plurality of such histograms) retains a substantial part of the informational content of the original signal, with only the phase information removed. According to the invention, the transformation is then used as the original signal itself, thus obviating costly and complicated conversion of the signal, or conversion of features extracted therefrom, between the time and frequency domains prior to and/or following processing.

Although the subsequent discussion is directed to apparatus for implementing the differencing function(s) defined in expression (1), the present invention envisions that histograms comprising the signal transformation are generated by different types of known "auto" or "cross" correlation functions of the general form:

$$\text{histogram}(d) = \lim_{N\to\infty}^{N} \frac{1}{2N+1} \sum_{n=-N}^{+N} u(n)v(n+d) \qquad (2)$$

If "u" is identical to "v" in expression (2), "histogram(d)" reduces to the well-known auto-correlation function. If "u" is not identical to "v", expression (2) represents a cross correlation function.

Referring now to FIG. 1A, a schematic diagram is shown of a correlator 20 for use in the present invention for generating histograms according to the "differencing" function of expression (1) when a=1. The correlator 20 includes a first section 24 having a top entrance 26 and a top exit 28. The correlator 20 also includes a second section 30 having a bottom entrance 32 and bottom exit 34. As designated by the arrow 36, the top exit 28 of the first correlator section 24 is connected to the bottom entrance 32 of the second correlator section 30. As also shown in FIG. 1A, the first correlator section 24 includes a temporary storage area 25 adjacent the exit 28 for temporarily storing a data sample, for the reasons to be described below.

For purposes of explanation only, the speech waveform 10 is shown in analog form inside the correlator 20. It should be appreciated, however, that in the actual method and apparatus of the present invention, the speech waveform 10 is first converted into a sequence of digital data samples. As seen in FIG. 1A, a sub-part of the speech waveform 10 is passed sequentially through the first correlator section 24, through the temporary storage area 25, and then into the second correlator section 30. As each new data sample enters the top entrance 26 of the first section 24, the remaining data samples in this correlator section are each shifted one position towards the exit 28. A data sample is then removed to the temporary storage area 25 and held there for a predetermined time period to be described. According to a feature of the present invention, data samples in the second correlator section 30 are then differenced with positionally-corresponding data samples in the first correlator section 24. As used herein, the term "positionally-corresponding" refers to data samples in the respective correlator sections at any moment in time located the same distance from the ends of the correlator. Therefore, the data sample 38 located adjacent the top entrance 26 of the first section 24 "positionally-corresponds" to the data sample 39 located adjacent the bottom exit 34 of the second section 30.

Figure 1B:
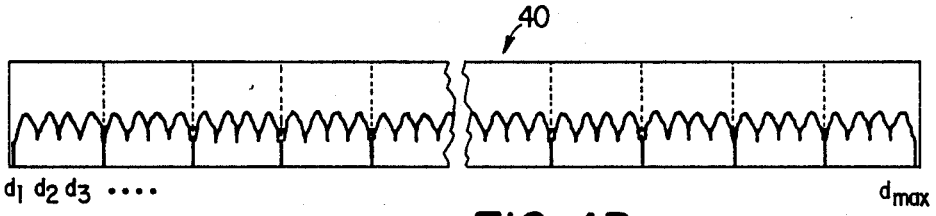
FIG. 1B is a histogram, partially cut-away, generated by the correlator of FIG. 1A.

Referring briefly now to FIG. 1B, correlation of the speech waveform in the first and second correlator sections 24 and 30 produces a histogram 40 having a plurality of predetermined "buckets" or positions from $d=1,2...$to $d_{max}$. The positions "$d_1,d_3,d_5$..." represent the "odd" values of the histogram with the positions "$d_2,d_4,d_6$..." representing the even values thereof. Although not shown in detail in FIG. 1B, the length of the histogram 40 is normally two times the length of each correlator section. Also, the length of each sub-part of the data sample sequence is typically greater than "$d=_{max}$."

With respect to expression (1), if a=0, the function reduces to the well-known average magnitude difference function (AMDF). If a=1, the function reduces to a so-called sliding average magnitude difference function (SAMDF), which differs from the AMDF in that the center point of the samples used to compute "histogram (d,1)" is the same for all values of "d". Because of this common reference, the SAMDF is used in the preferred embodiment of the invention and now described with respect to FIG. 2.

The SAMDF scheme begins at step 41 (assuming the correlator is filled with a portion of a first sub-part of the sequence) by initializing the $d_{max}$ positions of the histogram to zero. In step 42, a new data sample is moved into the first correlator section 24 and the remaining samples therein are shifted by one position. Step 42 therefore moves a data sample into the temporary storage area 25 for the first iteration of the calculation. In step 43, differences in magnitude between corresponding samples in the correlation sections are calculated. In particular, the magnitude of the first sample in the correlator section 24 adjacent the top entrance 26 thereof is differenced from the magnitude of the last sample in the correlator section 30 adjacent the bottom exit 34 thereof. This differencing step is also carried out for the rest of the samples at each position in the correlator sections. In step 44, the absolute values of the differences calculated in step 43 for each position in the correlator are then determined and in step 45, added to the summation to produce the "even" positions "$d_{2,4},d_6$..." of the histogram 40. Thereafter, an inquiry 46 is made to determine if a complete cycle of the histogram formation has been run. If not, the routine branches back to step 47, where the data sample in the temporary storage area 25 (received during the first iteration) is shifted into the second correlator section 30 and the remaining samples therein shifted by one position. Steps 43–45 are then repeated to increment the "odd" values "$d_1,d_3,d_5$..." of the histogram 40. If the result of inquiry 46 is positive, a test 48 is then made to see if "scnt" samples have been applied to the temporary storage area 25; if not, the routine branches back to step 42, and the method repeats as described above. If the result of inquiry 48 is positive, the histogram may be normalized (for example, by dividing each histogram value by "scnt") to produce the completed histogram for the first sub-part of the data sample sequence originally applied through the correlator sections. This process is then repeated in step 49 for additional sub-parts of the signal (applied through the correlator sections) to produce additional histograms comprising the signal transformation.

In the preferred embodiment, reference positions along the sample sequence are separated by a pitch period, or multiple thereof, of the signal. Also, when the SAMDF process of FIG. 2 is implemented, the data sample moved into the temporary storage area 25 after "scnt/2" cycles represents the reference position along the sub-part of the sequence.

Figure 2:
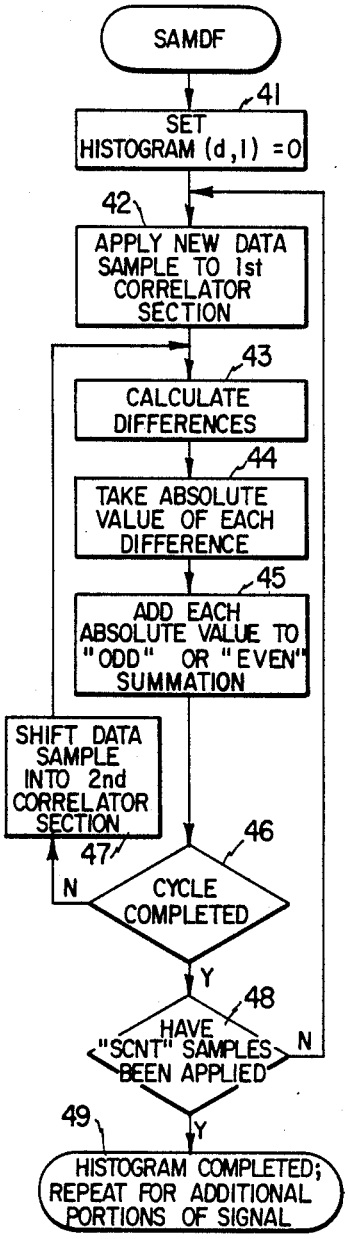
FIG. 2 is a flowchart diagram detailing the steps used to calculate the sliding average magnitude difference function (SAMDF) according to the present invention.

Referring briefly back to expression (1), it should be appreciated that there are other methods for implementing this expression besides the method steps shown in FIG. 2. For example, rather than shifting data samples into a correlator structure and producing the various summations as described, the expression may be calculated by initializing the histogram to its first position "$d_1$" (i.e., setting d=1), and summing over the range of "n" as shown in expression (1). This produces the value "histogram (1,a)". Thereafter, the histogram can be initialized to its second position "$d_2$," (d=2), and the process repeated until calculation of the histogram is completed.

Figure 3:
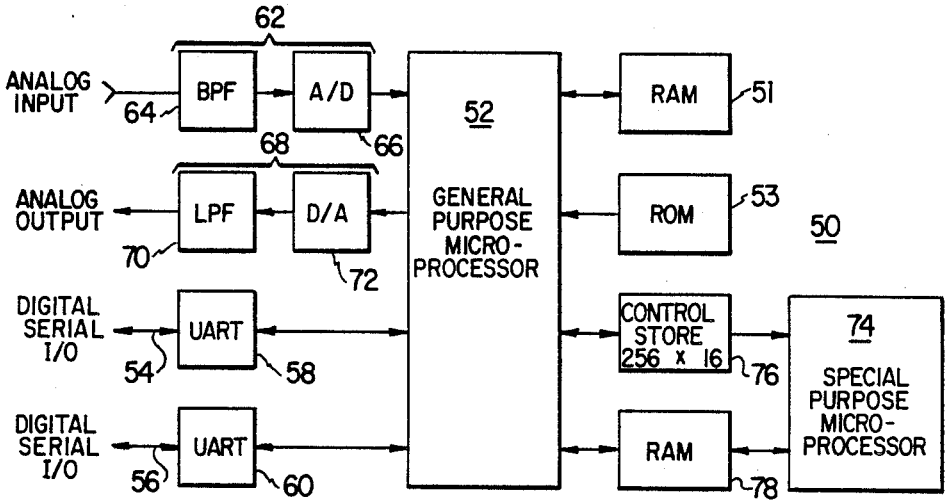
FIG. 3 is a block diagram of a speech system of the present invention for performing speech processing applications such as compression and synthesis.

Referring now to FIG. 3, a schematic block diagram is shown of a speech system 50 designed to provide the capabilities needed to produce the signal transformation according to the present invention, and also to provide the capabilities needed for using this transformation in speech processing applications. As discussed above, for the purposes of explanation only system 50 will be described in the context of a speech development system. System 50, however, is fully capable of interfacing with all types of signal processing applications, and the reference to speech-related applications herein is not meant to be limiting.

The speech system 50 includes a general purpose microprocessor 52 which has several input/output (I/O) devices tied thereto. Speech system 50 includes a pair of serial digital communication links 54 and 56 connected to the general purpose microprocessor 52 through universal asynchronous receiver/transmitters (UART's) 58 and 60, respectively. Such devices are well known and serve to interface the parallel word-based microprocessor 52 to the serial bit communication links 54 and 56. Speech system 50 also includes an analog input path 62 to the general purpose microprocessor 52 comprising bandpass filter 64 and analog-to-digital (A/D) converter 66. An analog output path 68 is also provided from the general purpose microprocessor 52 comprising low pass filter 70 and digital-to-analog (D/A) converter 72. An analog speech waveform is applied to the analog input path 62, where it is band limited by the filter 64, and digitized by the A/D converter 66. The digitized version of the speech waveform may then be transmitted over one of the digital serial communication links 54 or 56 to a remote system similar to the speech development system 50.

As also seen in FIG. 3, the general purpose microprocessor 52 includes an associated random access memory (RAM) 51 for storing application programs and data, and also a read only memory (ROM) 53 for storing operating programs which control the microprocessor 52.

According to a feature of the present invention, the speech system 50 includes a special purpose microprocessor 74 which, under the control of a software routine, carries out the SAMDF process of FIG. 2. Special purpose microprocessor 74 includes an associated control store 76 for storing this routine, and an associated random access memory (RAM) 78 for communicating with the general purpose microprocessor 52. General purpose microprocessor 52 passes digital data samples from the analog input path 62 into the RAM 78 and these samples are then processed in the special purpose microprocessor 74 under the control of a routine stored in control store 76. The resulting transformation of the speech waveform is then stored back in the RAM 78. The contents of RAM 78 are then read by general purpose microprocessor 52 without interrupting the continued processing of additional portions of the waveform by special purpose microprocessor 74.

Accordingly, special purpose microprocessor 74 operates concurrently with general purpose microprocessor 52 to enable the microprocessor 74 to carry out the SAMDF correlation calculations while the microprocessor 52 provides other system control functions.

Speech system 50 provides full duplex digital transceiver operation for facilitating real-time communications to and from the system. When the system 50 is initialized, control programs are down loaded into the RAM 51 associated with the general purpose microprocessor 52. These programs control the microprocessor 52 to down load the SAMDF routine into the control store 76 associated with special purpose microprocessor 74. The speech waveform is then received over the analog input path 62 and processed as described above.

According to an important feature of the present invention, once the signal transformation has been generated as discussed above, this transformation is then used as the signal itself by speech processing applications such as compression, synthesis and segmentation.

Figure 4:
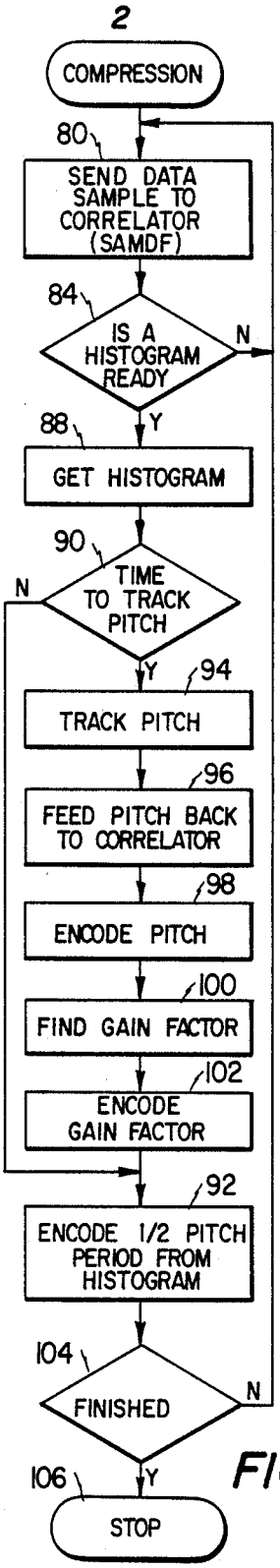
FIG. 4 is a flowchart diagram of a signal compression routine which uses the signal transformation generated by the SAMDF process to compress the original signal waveform.

Referring now to FIG. 4, a flowchart diagram is shown of a signal compression routine of the present invention which operates on the signal transformation to produce a compressed version of the original speech signal. As is known in the art, the object of speech compression is to represent analog speech with as few digital bits as possible. Prior art techniques, such as linear predictive coding (LPC), are based on the successful extraction of voice parameters from the speech signal and accurate voiced/unvoiced decisions. Although LPC and other prior art formant coding techniques provide effective speech signal compression in some applications, such techniques break down in noisy environments and when the speech signal is sampled at low data rates.

To ameliorate these and other problems of the prior art, the compression technique of the present invention takes advantage of certain informational redundancies inherent in the signal, which are also present in the signal transformation generated by the SAMDF process.

It has been found that a first source of informational redundancy in a speech signal exists because the speech waveform is substantially similar in any two contiguous pitch periods. Therefore, the storing of every other pitch period of the speech waveform represents a way to compress speech by a factor of 2:1. A second source of informational redundancy in the speech waveform is based on the notion that speech is normally a bipolar, approximately symmetrical waveform about an arbitrary reference level. If the waveform is rectified and zeros are eliminated therefrom, then the original waveform can be compressed by another factor of two, or by a total factor of 4:1. A third source of informational redundancy within the speech waveform is inherent in the way voiced signals are produced by the larynx. The glottal source has two phases, an open phase and a closed phase, and the resonances of the vocal tract are best represented in the speech waveform while the glottis is closed. Therefore, because the glottis is closed roughly 50% of the pitch period, only half of the speech waveform is carrying information during the pitch period itself. Accordingly, the storage of only one-half of a pitch period represents a way to compress the speech waveform by another factor of two, for a total compression ratio of 8:1.

Referring back to FIG. 1B, the SAMDF process correlates positive and negative phases of an input speech waveform, resulting in the histogram 40 with minimas corresponding to half cycles from the waveform. Accordingly, use of the SAMDF correlation process exploits the positive-to-negative cycle redundancy inherent in the speech waveform. Moreover, as also seen in FIG. 1B, the SAMDF process produces a highly symmetrical histogram 40, such that storage of only one-half of a pitch period represented in the histogram is required. Storage of one-half of a pitch period thus exploits the redundancy in the waveform resulting from the physical characteristics of the glottal source. Further, in the preferred embodiment of the invention, the histogram 40 is generated by the correlator 20 by selecting reference positions along the data sample sequence every other pitch period, such that the histogram represents an "averaged" correlation over two pitch periods. This feature of the invention thus exploits the pitch period-to-pitch period redundancy inherent in the input speech waveform resulting in a total compression ratio of 8:1.

The compression routine in FIG. 4 begins at instruction 80 wherein data samples are moved into the RAM 78, where they are processed by the special purpose microprocessor 74. As discussed above with respect to FIG. 3, the data samples are obtained from conversion of an analog sound wave by the A/D converter 66. The SAMDF correlation is then carried out in step 80 by the special purpose microprocessor 74 of FIG. 3 under the control of a software routine stored in the associated control store 76.

After each new data sample is moved into the RAM 78, a check 84 is made to determine whether or not a completed histogram (as described with respect to FIG. 2) is ready for further processing. If the histogram is not ready, control returns to step 80, and another data sample is moved into the RAM 78 as previously described by step 42 in FIG. 2. When the histogram is ready, i.e., the test in step 84 is positive, the histogram is moved from the RAM 78 to the RAM 51 in step 88, so that it can be processed by the general purpose microprocessor 52.

Referring back to FIG. 4, the signal compression routine continues in step 90 to determine whether it is time to track the pitch of the waveform. If the result of the inquiry 90 is negative, i.e., if the time interval for tracking pitch has not elapsed, the routine branches to step 92 wherein one-half of the pitch period is encoded from the histogram, preferably by using two-bit adaptive differential pulse code modulation (ADPCM).

Encoding of the compressed waveform incurs some overhead; for example, the frequency, or length of the pitch period, must be stored with the encoded waveform. In order to minimize this overhead, and because the pitch of voiced speech does not change rapidly, the system preferably tracks the pitch of the input speech signal only at certain time intervals, which may vary from as frequently as each pitch period to as infrequently as several pitch periods.

Returning to FIG. 4, if the result of inquiry 90 is positive, then the routine continues with step 94 to determine the pitch period. In step 96, the routine continues by feeding the pitch period determined in step 94 back to the special purpose microprocessor 74. In step 98, the pitch is encoded with the routine continuing in step 100 to calculate the maximum amplitude in the pitch period, or gain factor. In step 102, the gain factor is then encoded, preferably using a log(base 2) representation, and the routine continues with step 92 as discussed above. Following step 92, an inquiry 104 is made to determine whether compression is complete. If not, the routine recycles back to step 80 wherein additional portions of the speech signal are digitized and the compression routine continues as described above. If compression is completed, then the routine terminates at step 106.

As detailed in the flowchart diagram of FIG. 4, the first analysis performed on the histogram is pitch extraction. Pitch is determined by examining minimas in the histogram, analyzing for harmonic relations and selecting a first pitch trough. This value is then used to control the amount of time over which the next histogram will be summed. An effect of the process is to produce highly symmetrical histograms, so that only one-half of the pitch period in the histogram need be stored. This provides a 2:1 factor of compression in the speech waveform. Moreover, according to the method, histograms are output every other pitch period to provide another 2:1 factor of compression, or a total compression ratio of 4:1. As also noted above, the encoding step 92 codes the histograms using a two-bit ADPCM scheme modulation scheme. This represents another factor of four compression on the original eight-bit digitized waveform. Thus, the total compression ratio of the technique is 16:1.

Figure 5:
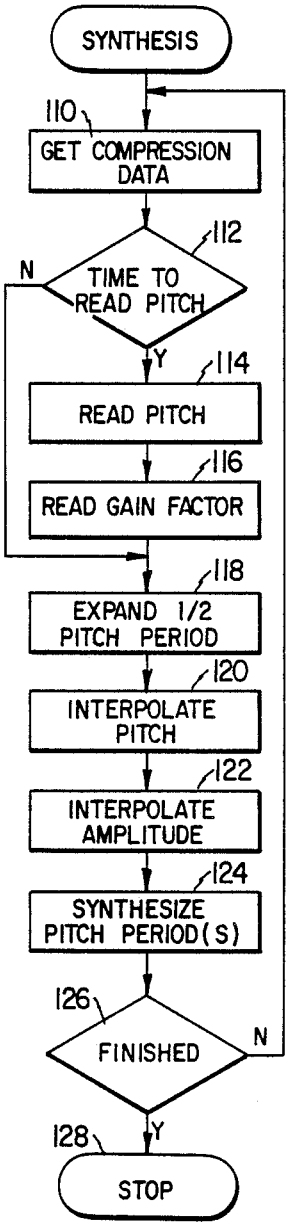
FIG. 5 is a flowchart diagram of a signal synthesis routine for synthesizing the signal compressed by the signal compression routine diagrammed in FIG. 4.

Referring now to FIG. 5, a flowchart diagram of a signal synthesis routine of the present invention is shown. As discussed above, this routine operates on the SAMDF signal transformation generated by the special purpose microprocessor, and in particular on the transformation as compressed by the compression routine set forth in FIG. 4. Synthesis begins with instruction 110, wherein the routine is initialized by receiving data representing the compressed speech signal. The routine continues with inquiry 112 which determines whether the pitch period should be read. If the result of the inquiry 112 is positive, the routine continues in step 114 to read the pitch period from the bitstream data received over one of digital serial communication links of FIG. 3. Thereafter, the gain factor is read in step 116 from the bitstream data. Following step 116, or if the result of inquiry 112 is negative, the method continues in step 118, wherein one-half of the pitch period for the compressed segment is expanded from the bitstream data. In step 120, the pitch of the segment is interpolated, as is the gain factor in step 122. The routine continues in step 124 to synthesize the pitch period(s). Following step 124, the routine enters inquiry 126 to determine whether the speech waveform synthesis has been completed. If not, the method returns to step 110 to get data to synthesize the next segment. If the synthesis is complete, the routine terminates at step 128.

Accordingly, synthesis occurs in four steps. Preferably, the stored encoded pitch and gain factors are first read and decoded. The second step consists of a simple expansion of the histogram from ADPCM to pulse code modulation (PCM) format, which is accomplished in step 118 of FIG. 5. Thereafter, the reconstructed waveform is reflected in step 124 to form the pitch period. The fourth and final step is to repeat the pitch period, with the process then repeated for each subsequent portion of the compressed speech waveform.

Accordingly, the present invention provides a method and apparatus for generating a transformation of a signal waveform useful in speech processing for example, compression and synthesis. This transformation retains the informational content of the original signal and therefore is used directly to represent the signal. The "use" of the signal transformation as the signal itself obviates costly and complex computational algorithms for converting the signal (or features thereof) between the time and frequency domains prior to and following the signal processing application(s). In the preferred embodiment of the invention, a special purpose microprocessor is provided to run a software routine for generating the transformation by calculating a sliding average magnitude difference function (SAMDF) histogram for continuous segments of the speech waveform.

As discussed above, although the method and apparatus of the present invention has been described in detail with respect to speech processing applications such compression/synthesis, it should be appreciated that the techniques described herein are fully compatible with all types of signal processing applications. Accordingly, the scope of the present invention is not limited to use of the signal transformation to effect speech compression/synthesis.

Although the invention has been described and illustrated in detail, it is clearly understood that the same is by way of illustration and example only and is not to be taken by way of limitation. The spirit and scope of the present invention are to be limited only by the terms of the appended claims.

We claim:

1. A method for generating a transformation of an original periodic signal from a plurality of histograms where the transformation retains a substantial part of the information content for additional processing, comprising the steps of:

converting all or a part of the original signal into a sequence of data samples, selecting a first reference position in a first subpart of the sequence of data samples, generating a first histogram having a plurality of predetermined positions for the first subpart from the reference position in accordance with a selected correlation function, the first subpart having a number of data samples greater than the plurality of predetermined positions of the first histogram, selecting a second reference position from a second subpart of the sequence of data samples, the second reference position located from the first reference position by a distance related to a period or multiple periods of the original signal, generating a second histogram having a plurality of predetermined positions for the second subpart from the second reference position in accordance with the selected correlation function, the second subpart having a number of data samples greater than the plurality of predetermined positions of the second histogram, processing the first and second histograms as the transformation of the original signal retaining a substantial part of the informational content of the original signal.

2. The method for generating a transformation of a signal as described in claim 1 wherein the correlation function is an average magnitude difference function (AMDF).

3. The method for generating a transformation of a signal as described in claim 1 wherein the correlation function is a sliding average magnitude difference function (SAMDF).

4. The method for generating a transformation of a signal as described in claim 1 wherein the correlation function is an auto-correlation function.

5. A method for generating a transformation of an original periodic signal from a plurality of histograms where the transformation retains a substantial part of the information content for additional processing, comprising the steps of:

(a) converting all or a part of the original signal into a sequence of data samples, (b) selecting a first reference position in a first subpart of the sequence of data samples, (c) generating a first histogram having $(d)_{max}$ positions greater in number than the data samples in the first subpart starting from the first reference position in accordance with the expression:

$$\text{histogram}(d,a) = \frac{1}{scnt} \sum_{n=n_0-\left\lfloor \frac{scnt+a\cdot d}{2} \right\rfloor}^{n_0+\left\lfloor \frac{scnt+a\cdot d}{2} \right\rfloor} |x(n) - x(n+d)|$$

for $d = 1,2, \ldots d_{max}$ where:

x(.) is the sampled signal, $n_o$ is a reference position, d=time lag between samples, scnt=averaging interval in samples, and a=0, 1

(d) selecting second reference position from a second subpart of the sequence of data samples, the second reference position located from the first reference position by a distance related to a period or multiple periods of the original signal, (e) repeating step (c) for the second subpart from the second reference position to generate a second histogram, the second histogram having positions fewer in number than the data samples in the second subpart, and (f) processing the first and second histograms as the transformation of the original signal retaining a substantial part of the information content of the original signal in a signal processing application.

6. The method for generating a transformation of a signal as described in claim 5 wherein said step of generating a histogram operates over "scnt" samples in place thereof for each reference position.

7. The method for generating a transformation of a signal as described in claim 6 wherein said step of generating a histogram for each reference position includes the steps of:

(g) applying the digital data samples through a correlator having first and second sections and a temporary storage area, an output of said first correlator section forming an input to said second correlator section through the temporary storage area; and (h) moving a new data sample into the first correlator section and shifting the remaining data samples therein by one position, whereby a data sample is removed from said first correlator section to said temporary storage area.

8. The method for generating a transformation of a signal as described in claim 7 wherein each said cycle of the histogram includes the steps of:

(i) differencing a magnitude of each data sample in said second correlator section with a magnitude of a positionally-corresponding data sample in said first correlator section;

(j) determining an absolute value of each difference calculated in step (i) to produce "even" values of the histogram;

(k) moving said data sample in said temporary storage area into the second correlator section and shifting the remaining data samples therein by one position;

(1) repeating steps (i)–(j) to produce "odd" values of the histogram.

9. The method for generating a transformation of a signal as described in claim 5 including the step of compressing the signal transformation.

10. The method as in claim 9 wherein the step of compressing the signal includes the step of storing only one-half of the pitch period of each histogram to obtain a 2:1 compression.

11. The method as in claim 10 further including the step of outputting a histogram only every other pitch period to further compress the signal by another factor of 2 for a total compression of 4:1.

12. The method as in claim 11 further including the step of encoding only one-half of the pitch period of said histogram by using tow-bit adaptive differential pulse code modulation to further compress the signal by a factor of 4 to obtain a total compression of 16:1.

13. The method for generating a transformation of a signal as described in claim 5 wherein said signal processing applications include the step of synthesizing said transformation from said compressed version of said signal.

14. The apparatus for generating a transformation of a signal as described in claim 5 wherein said processing means further includes:

means for synthesizing the signal compressed by the means for producing a compressed version to resynthesize the signal transformation.

15. Apparatus for generating a transformation of an original periodic signal from a plurality of histograms where the transformation retains a substantial part of the informational content for additional processing, comprising:

means for converting all or a part of the original signal into a sequence of digital data samples, means for selecting a first reference position in a first subpart of the sequence of data samples, means for generating a first histogram having a plurality of predetermined positions for the first subpart from the first reference position in accordance with a selected correlation function, the first subpart having a number of data samples greater than the plurality of predetermined positions of the first histogram, means for selecting a second reference position from a second subpart of the sequence of data samples, the second reference position located from the first reference position a distance related to a period or multiple periods of the original signal, means responsive to said means for generating the first histogram for generating a second histogram having a plurality of predetermined positions for the second subpart from the second reference position in accordance with the selected correlation function, the second subpart having a number of data samples greater than the plurality of predetermined positions of the second histograms, and means for processing the first and second histograms as the transformation of the original signal retaining a substantial part of the informational content of the original signal in accordance with a signal processing application.

16. The apparatus as in claim 15 wherein said processing means includes:

means for storing only one-half of the pitch period of the signal in each histogram to obtain a 2:1 compression, means coupled to said storing means for generating a histogram only every other pitch period to further compress the signal by a factor of 2 for a total compression of 4:1; and means coupled to said histogram generating means for encoding only one-half of the pitch period from said histogram by using two-bit adaptive differential pulse code modulation to further compress the signal by a factor of four to obtain a total compression of 16:1.

17. A method for generating a transformation of an original periodic signal from a plurality of histograms where the transformation retains a substantial part of the informational content for additional processing, comprising the steps of:

converting all or a part of the original signal into a sequence of data samples, selecting a first reference position in a first subpart of the sequence of data samples, generating a first histogram having a plurality of predetermined positions for the first subpart from the first reference position in accordance with a selected correlation function, the first subpart having a number of data samples greater than the plurality of predetermined positions of the first histogram, selecting a reference position for each of a plurality of additional subparts of the sequence of data samples, wherein the reference position for each of the additional subparts is located from a previously selected reference position by a distance related to a period or multiple periods of the original signal, generating a histogram having a plurality of predetermined positions for each of the additional plurality of subparts from the reference position for each subpart, all such histograms generated in accordance with the selected correlation function and having the number of predetermined positions fewer in number than the number of data samples of the related subpart, and processing the first histogram and the histogram for each of the plurality additional subparts as a transformation of the original signal retaining a substantial part of the informational content of the original signal.

* * * * *

UNITED STATES PATENT AND TRADEMARK OFFICE

CERTIFICATE OF CORRECTION

PATENT NO. : 4,969,193

DATED : November 6, 1990

INVENTOR(S) : Brian L. Scott, et al.

It is certified that error appears in the above-identified patent and that said Letters Patent is hereby corrected as shown below:

Column 4, lines 54-55, "and-", should be "and".

Column 5, line 54, "$d=_{max}$", should be "$d_{max}$"

Column 6, line 17, "$d_{2,4,d_6}$...", should be "$d_2,d_4,d_6$..."

Column 11, line 65, after "a", delete "first".

Column 12, line 34, after "samples", delete "in place thereof".

Signed and Sealed this

Twenty-ninth Day of December, 1992

*Attest:*

DOUGLAS B. COMER

*Attesting Officer*

*Acting Commissioner of Patents and Trademarks*